US012799668B2

(12) United States Patent
Rodriguez Munoz et al.

(10) Patent No.: US 12,799,668 B2
(45) Date of Patent: Nov. 17, 2026

(54) METHOD FOR SCHEDULING AND EXECUTING A WARMUP CYCLE IN A DRYER APPLIANCE

(71) Applicant: Haier US Appliance Solutions, Inc., Wilmington, DE (US)

(72) Inventors: Jose Efren Rodriguez Munoz, Louisville, KY (US); Joshua Reeves, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 869 days.

(21) Appl. No.: 17/965,321

(22) Filed: Oct. 13, 2022

(65) Prior Publication Data

US 2024/0125040 A1 Apr. 18, 2024

(51) Int. Cl.

| | |
|---|---|
| ***D06F 58/40*** | (2020.01) |
| ***D06F 34/04*** | (2020.01) |
| ***D06F 34/06*** | (2020.01) |
| ***D06F 34/08*** | (2020.01) |
| ***D06F 34/26*** | (2020.01) |

(Continued)

(52) U.S. Cl.

CPC ..... *D06F 58/40* (2020.02); *D06F 34/04* (2020.02); *D06F 34/06* (2020.02); *D06F 34/08* (2020.02); *D06F 34/26* (2020.02); *D06F 34/28* (2020.02); *D06F 58/02* (2013.01); *D06F 58/46* (2020.02); *D06F 2101/14* (2020.02);

(Continued)

(58) Field of Classification Search

CPC ..... D06F 58/40; D06F 34/06; D06F 34/04; D06F 34/26; D06F 34/28; D06F 58/46; D06F 34/08; D06F 558/02; D06F 2101/14; D06F 2103/32; D06F 2101/18; D06F 2105/14

See application file for complete search history.

(56) References Cited

U.S. PATENT DOCUMENTS

2007/0283592 A1* 12/2007 Slutsky ..... D06F 58/34 34/446

2010/0127854 A1 5/2010 Helvick et al.

(Continued)

FOREIGN PATENT DOCUMENTS

CN 109706690 B 11/2020
CN 108950978 B 1/2021

(Continued)

OTHER PUBLICATIONS

English Translation of DE1020107244A1 (Year: 2019).*

*Primary Examiner* — Connor J Tremarche
(74) *Attorney, Agent, or Firm* — Dority & Manning, P.A.

(57) ABSTRACT

A dryer appliance and a method of operating the dryer for a warming operation is provided. The dryer appliance includes an air handler to urge the flow of air through a chamber rotatably mounted in a cabinet and a heating assembly for heating the flow of air. A controller controls the heating assembly and the air handler to initiate a warming operation for an article in the chamber. The warming operation includes receiving input parameters for a warming operation and determining a duration of the warming operation from the input parameters. Based on the input parameters and duration of the warming operation a start time is determined and the warming operation is initiated at the determined start time.

16 Claims, 3 Drawing Sheets

(51) Int. Cl.

| | |
|---|---|
| ***D06F 34/28*** | (2020.01) |
| ***D06F 58/02*** | (2006.01) |
| ***D06F 58/46*** | (2020.01) |
| *D06F 101/14* | (2020.01) |
| *D06F 101/18* | (2020.01) |
| *D06F 103/32* | (2020.01) |
| *D06F 105/14* | (2020.01) |

(52) U.S. Cl.
CPC ..... *D06F 2101/18* (2020.02); *D06F 2103/32* (2020.02); *D06F 2105/14* (2020.02)

(56) References Cited

U.S. PATENT DOCUMENTS

| | | | | |
|---|---|---|---|---|
| 2012/0084995 | A1 | 4/2012 | Vogel | |
| 2017/0115652 | A1 | 4/2017 | Grossman, IV et al. | |
| 2018/0195229 | A1* | 7/2018 | Pistochini | D06F 58/38 |
| 2019/0106831 | A1* | 4/2019 | Benedetto | D06F 58/203 |
| 2019/0385017 | A1* | 12/2019 | Hwang | G06F 18/214 |
| 2020/0157731 | A1* | 5/2020 | Del Puppo | D06F 58/38 |
| 2020/0199800 | A1 | 6/2020 | Han et al. | |
| 2023/0004135 | A1* | 1/2023 | Bellinger | D06F 58/52 |

FOREIGN PATENT DOCUMENTS

| | | | | | |
|---|---|---|---|---|---|
| DE | 102018107244 | A1 * | 10/2019 | | D06F 58/46 |
| EP | 2497856 | A1 * | 9/2012 | | D06F 58/38 |
| JP | H05137899 | A | 6/1993 | | |
| JP | 2000102698 | A | 4/2000 | | |
| WO | WO2014168559 | A1 | 10/2014 | | |

* cited by examiner

METHOD FOR SCHEDULING AND EXECUTING A WARMUP CYCLE IN A DRYER APPLIANCE

FIELD OF THE INVENTION

The present disclosure relates generally to dryer appliances, and more particularly to systems and methods for performing a warmup cycle in a dryer appliance.

BACKGROUND OF THE INVENTION

Dryer appliances are commonly used to dry a load of wet clothes following a laundry process, for example after a washing process in a washing machine appliance. After the washing machine process is complete, the load of wet clothes is moved to the dryer, which includes a cabinet with a drum rotatably mounted therein and a heating assembly that supplies heated air into a chamber of the drum to facilitate a drying process. The duration of the drying process may be selected by a user at the time the process is started, or the dryer appliance may determine the duration of a user-initiated drying process when a sensed degree of dryness of the clothes corresponds with a user-selected level of dryness. The user may select a temperature range (e.g., high, medium, low, etc.) for the heated air entering the chamber for the drying process.

In some instances, a user may desire a dryer appliance to warm already dried clothes and have the warmed clothes available at a user-selected temperature and at a preselected future time, chosen by the user, for example just before the user anticipates putting the clothes on. Known dryer appliances process a load of wet clothes for a user-selected time period or until the dryer appliance detects a preselected level of dryness. Neither drying scheme provides a warmup cycle to make available warmed clothes at a user-selected temperature and at a user-selected future time. Accordingly, improvements to systems and methods for executing a warmup cycle are desirable.

BRIEF DESCRIPTION OF THE INVENTION

Aspects and advantages of the invention will be set forth in part in the following description, or may be apparent from the description, or may be learned through practice of the invention.

In one exemplary aspect, a dryer appliance comprising a drum rotatably mounted in a cabinet and defining a chamber for receipt of articles for warming is provided. An air handler is provided for urging the flow of air through the chamber and a heating assembly heats the flow of air. A controller is in operable communication with the heating assembly and air handler and is configured to initiate a warming operation on articles in the drum. The warming operation comprises receiving input parameters of the warming operation; determining a duration of the warming operation from the input parameters; determining a start time for the warming operation from the input parameters and the determined duration; and initiating the warming operation for the article at the determined start time.

In another example aspect, a method of operating a dryer appliance comprising a drum rotatably mounted within a cabinet and an article in the drum is provided. The method comprises determining a duration of the warming operation from the input parameters; determining a start time for the warming operation from the input parameters and the determined duration; and initiating the warming operation for the article at the determined start time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
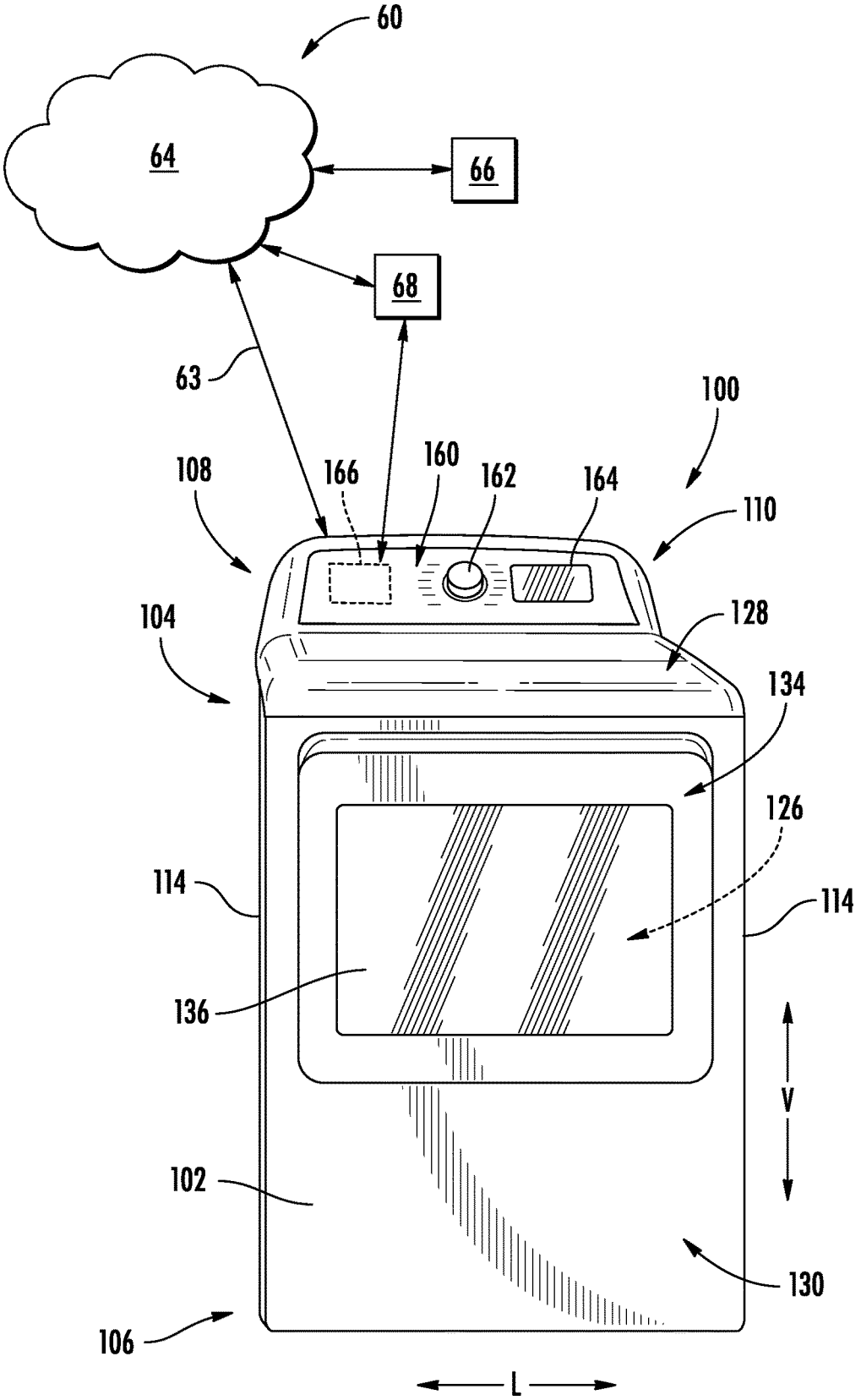
FIG. 1 provides a perspective view of a dryer appliance and an external communication system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
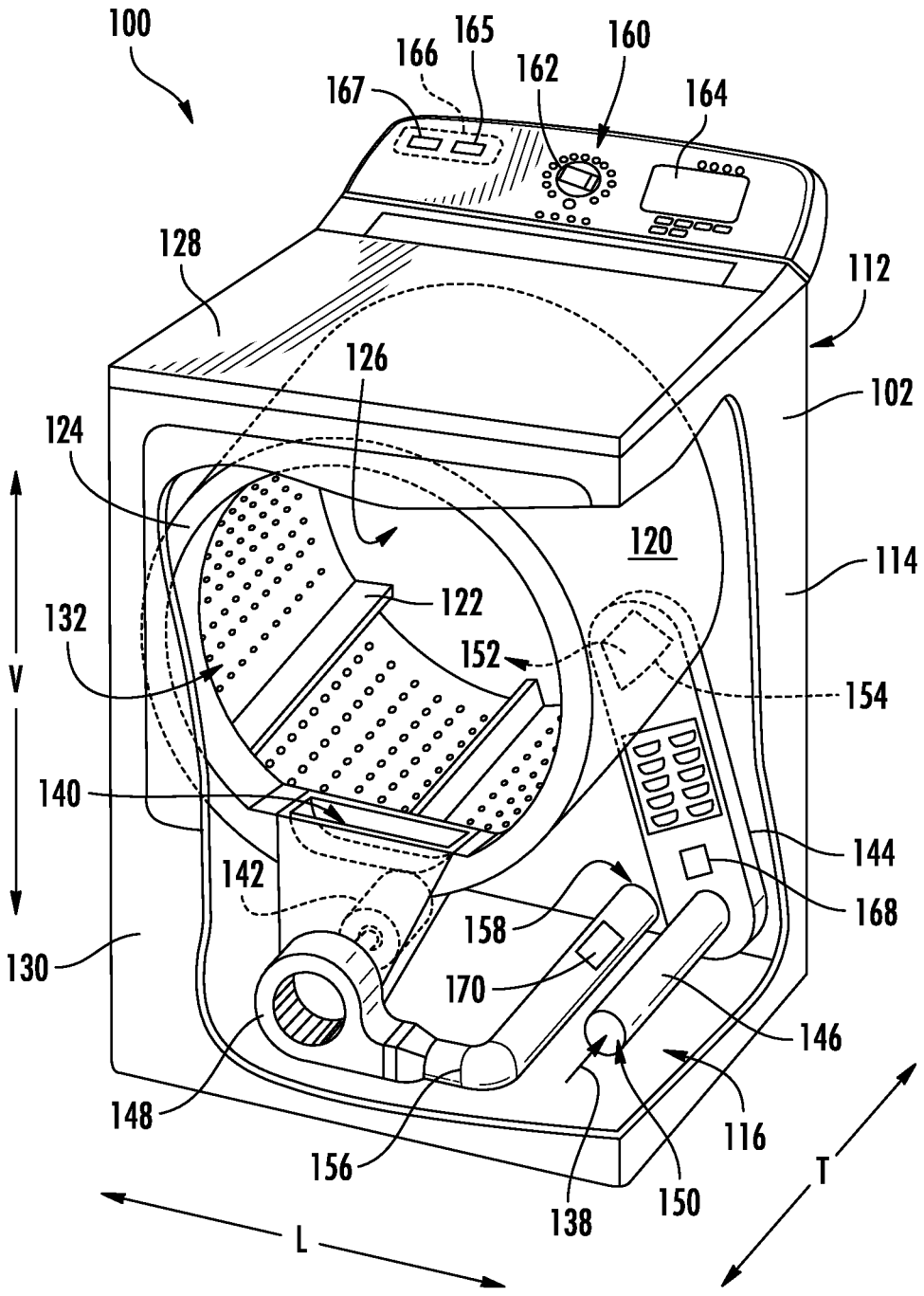
FIG. 2 provides a front perspective view of the dryer appliance of FIG. 1 with the door and portions of the cabinet removed to reveal certain components of the dryer appliance.

Turning to the figures, FIG. 1 provides a perspective view of an exemplary household appliance, front-load dryer appliance 100. FIG. 2 represents the dryer appliance of FIG. 1 with portions of the cabinet 102 removed to reveal certain internal components. As illustrated, dryer appliance 100 generally defines a vertical direction V, a lateral direction L, and a transverse direction T (FIG. 2), each of which is mutually perpendicular, such that an orthogonal coordinate system is defined. Dryer appliance 100 includes a cabinet 102 that extends between a top 104 and a bottom 106 along the vertical direction V, between a left side 108 and a right side 110 along the lateral direction L, and between a front and a rear along the transverse direction T.

A drum 120 may be received within cabinet 102 and define a drying chamber, chamber 126, that is configured for receipt of articles for drying. In some embodiments, chamber 126 is configured for receipt of articles for warming. More specifically, drum 120 may be rotatably mounted within cabinet 102 such that it is rotatable about a rotation axis. Generally, the rotation axis is defined non-parallel to the vertical direction V (e.g., closer to perpendicular than parallel). According to the illustrated embodiments, the rotation axis is substantially parallel to the transverse direction T. In this regard, dryer appliance 100 is generally referred to as a "horizontal-axis" or "front-load" dryer appliance 100.

While described in the context of a specific embodiment of front load dryer appliance 100, using the teachings disclosed herein it will be understood that front load dryer appliance 100 is provided by way of example only. Other combination washing machine or dryer appliances having different configurations, different appearances, or different features may also be utilized with the present subject matter as well.

Drum 120 may define one or more features that extend into chamber 126 to assist in tumbling articles disposed within chamber 126 during operation of dryer appliance 100. For example, a plurality of tumbling ribs 122 may extend from drum 120 into chamber 126. In this manner, for example, the tumbling ribs 122 may lift articles disposed in drum 120 during rotation of drum 120.

As shown in FIG. 1, cabinet 102 also includes a front panel 130 that defines, at least in part, an opening 132 that permits user access to drum 120. More specifically, dryer appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to drum 120 and a closed position (FIG. 1) prohibiting access to drum 120. For reference, door 134 is removed in FIG. 2 to show other elements of dryer appliance 100.

In some embodiments, a central body 136 of door 134 is provided on a rim that extends about at least a portion of central body 136. In optional embodiments, central body 136 is provided as a window and permits viewing of drum 120 when door 134 is in the closed position (e.g., during operation of dryer appliance 100).

Door 134 may also include a handle (not shown) that, for example, a user may pull when opening door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle may extend between drum 120 and the front panel 130 about the opening 132 covered by door 134, further sealing drum 120 from cabinet 102. For example, when door 134 is in the closed position, the baffle may contact central body 136 in sealing engagement therewith and within the perimeter of door 134. Additionally or alternatively, a lint trap duct 140 may be provided at opening 132. A lint filter (not shown) may be inserted into the lint trap duct 140 in the space between front panel 130 and drum to catch fabric particles, i.e., lint, that clothes being dried in the chamber 126 may give off.

In some embodiments, a control panel 160 including a plurality of input selector knobs 162 may be coupled a portion of the cabinet 102, for example to top panel 128. Control panel 160 and input selector knobs 162 may collectively form a user interface input for operator selection of machine cycles and features. For example, in exemplary embodiments, a display 164 indicates selected features, a countdown timer, or other items of interest to machine users.

Operation of dryer appliance 100 is generally controlled by a processing device, controller 166. In some embodiments, controller 166 is in operative communication with (e.g., electrically or wirelessly connected to) control panel 160 for user manipulation to select dryer cycles and features. In response to user manipulation of control panel 160, controller 166 operates the various components of dryer appliance 100, for example the motor 142, air handler 148, and heating assembly 146, to execute selected machine cycles and features (e.g., as part of a drying operation). Alternatively, a touch screen type interface, knobs, sliders, buttons, speech recognition, etc., mounted to cabinet backsplash or at any other suitable location to permit a user to input control commands for dryer appliance 100 or controller 166.

In some embodiments, control panel 160 may allow a user to choose a warmup cycle or warming operation to be completed at a time in the future. A user may enter the time, or date and time, an article or articles are desired to be readied by heating to a user-specified temperature, the termination temperature, of the warming operation. The control panel 160 is coupled with the controller 166 to process the user requests of time and temperature for the warming operation completion. The control panel 160 may also provide the user with an option to choose the speed of the warming operation or the efficiency of the warming operation. For instance, if the warmed articles are requested in a very short time period, the warming operation would be less efficient if a longer time period was chosen.

Controller 166 may include memory 167 and one or more processing devices 165 such as microprocessors, CPUs or the like, such as general or special purpose microprocessors operable to execute programming instructions or micro-control code associated with operation of dryer appliance 100. The memory 167 can represent random access memory such as DRAM, or read only memory such as ROM or FLASH. The memory 167 can store, for example, historical data of previous cycles, airflow conditions in the dryer appliance 100, load size, inlet and vent temperature sensor readings, operating parameters, cycle settings, performance characteristics, user preferences, efficiencies, or any other suitable information as may be useful in operation of the dryer appliance 100. The processor executes programming instructions stored in the memory. The memory may be a separate component from the processor or may be included onboard within the processor. Alternatively, controller 166 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

In general, controller 166 is in operative communication with various components of dryer appliance 100. In particular, controller 166 is in operative communication with motor 142 and heating assembly 146. Thus, upon receiving an activation signal from cycle selector knob 162, controller 166 can activate motor 142 to rotate drum 120 and air handler 148. Controller 166 can also activate heating assembly 146 in order to generate heated air for drum 120, e.g., in the manner described above.

As illustrated, FIG. 2 provides a perspective view of dryer appliance 100 with a portion of a cabinet 102 of dryer appliance 100 removed in order to show certain internal components of dryer appliance 100. Cabinet 102 includes a front panel 130, a rear panel 112, a pair of side panels 114 spaced apart from each other by front and rear panels 130, 112, a bottom panel 116, and a top panel 128.

A motor 142 is configured for rotating drum 120 about the horizontal axis, e.g., via a pulley and a belt (not shown). Drum 120 is generally cylindrical in shape, having an outer cylindrical wall or cylinder and a front flange or wall that defines an entry 124 of drum 120, e.g., at the front portion of drum 120, for loading and unloading of articles into and out of chamber 126 of drum 120. A duct 144 is mounted to the rear wall of drum 120 and receives heated air that has been heated by a heating assembly 146.

Motor 142 is also in mechanical communication with an air handler 148 such that motor 142 rotates air handler 148, e.g., a centrifugal fan. Air handler 148 is configured to draw or urge air through chamber 126 of drum 120, e.g., in order to dry articles located therein. In alternative exemplary embodiments, dryer appliance 100 may include an additional motor (not shown) for rotating air handler 148 independently of drum 120.

Drum 120 is configured to receive heated air from heating assembly 146 in order to dry damp articles disposed within chamber 126 of drum 120. Heating assembly 146 includes a heating element (not shown), such as a gas burner or an electrical resistance heating element, for heating air. As discussed above, during operation of dryer appliance 100, motor 142 rotates drum 120 and air handler 148 such that air handler 148 draws or urges air through chamber 126 of drum 120 when motor 142 rotates. In particular, ambient air (identified herein generally by reference numeral 138) enters heating assembly 146 via an entrance 150 due to air handler 148 urging such ambient air into entrance 150. Such ambient air 138 is heated within heating assembly 146 and exits heating assembly 146 as heated air 152. Air handler 148 draws or urges such heated air through duct 144 to drum 120. The heated air enters drum 120 through an outlet 154 of duct 144 positioned at the rear wall of drum 120.

Within chamber 126, the heated air can accumulate moisture, e.g., from damp articles disposed within chamber 126. In turn, air handler 148 draws or urges humid air through lint trap duct 140 which contains a screen filter (not shown) which traps lint particles. Such humid air then passes through lint trap duct 140 and air handler 148 before entering an exhaust conduit 156. From exhaust conduit 156, such humid air passes out of dryer appliance 100 through a vent 158 defined by cabinet 102.

Controller 166 is also in communication with one or more temperature sensors, such as inlet temperature sensor 168, and vent temperature sensor 170. Inlet and vent temperature sensors 168, 170 may be, for example, thermocouples, thermistors, resistance temperature detectors, semiconductor-based integrated circuit temperature sensors, etc. Inlet temperature sensor 168 is configured for measuring a temperature of heated air within duct 144 and can be positioned at any suitable location within dryer appliance 100. For example, temperature sensor 280 may be positioned within or on duct 144. Vent temperature sensor 170 is configured for measuring a temperature of exhaust air in the exhaust conduit 156. Controller 166 can receive signals from temperature sensors 168, 170 that corresponds to a temperature measurement of heated air within duct 144 and exhaust conduit 156. That is, the temperatures of heated air 152 entering the drum 120 and exiting the drum in exhaust conduit 156 can be measured.

Referring back to FIG. 1, a schematic diagram of an external communication system 60 will be described according to an exemplary embodiment of the present subject matter. In general, external communication system 60 is configured for permitting interaction, data transfer, and other communications between dryer appliance 100 and a user of such appliance. For example, this communication may be used to provide and receive historical data of previous cycles, airflow conditions in the dryer appliance 100, load size, inlet and vent temperature sensor readings, operating parameters, cycle settings, performance characteristics, user preferences, efficiencies, or any other suitable information for improved performance of dryer appliance 100.

As illustrated above, dryer appliance 100 may include a controller 166. External communication system 60 permits controller 166 of dryer appliance 100 to communicate with external devices either directly through a direct link 63 or through a network 64. For example, a consumer may use a consumer device 66 linked to the controller 166 to communicate directly with dryer appliance 100. Alternatively, the dryer appliance 100 may include user interfaces for receiving such input. For example, consumer devices 66 may be directly or indirectly linked to the dryer appliance 100. That is, consumer device 66 may be in direct or indirect communication (i.e., linked) with the controller 166 of dryer appliance 100, e.g., directly through a local area network (LAN), Wi-Fi, Bluetooth, Zigbee, etc. or indirectly through network 64. In general, consumer device 66 may be any suitable device for providing or receiving communications or commands from a user. In this regard, consumer device 66 may include, for example, a personal phone, a tablet, a laptop computer, or another mobile device.

Consumer device 66 may be used to request a warming operation to be performed by the dryer appliance 100. Similar to the warming operation requested through the control panel 160, consumer device 66 may be used to request an operation performed to prepare an article in a certain state or condition at a certain time in the future. The desired time for the warmed articles to be ready and the desired condition, for example temperature, are input parameter to be entered by the user on the consumer device 66. The consumer device 66 is linked directly or indirectly to the dryer appliance 100, for example to the controller 166. The controller 166 has a memory 167 operable to store and retrieve performance data of historical operations of the dryer appliance 100. The controller also has a processing device 165 operable retrieve the historical operating data and to execute programming instructions stored in the memory 167 to determine parameters for various operations, for example warming operations. The controller 166 also includes a clock for determining local time and for controlling timed operations in the operation of the dryer appliance 100.

In addition, a remote server 68 may be in communication with dryer appliance 100, or consumer device 66 through network 64. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g. TCP/IP, HTTP, SMTP, FTP), encodings or formats (e.g. HTML, XML), or protection schemes (e.g. VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, historical data, transfer operating parameters, or performance characteristics, etc. In addition, consumer device 66 and remote server 68 may communicate with dryer appliance 100 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Now that the construction of dryer appliance 100 and the configuration of controller 166 according to exemplary embodiments have been presented, an exemplary method 200 of operating a dryer appliance will be described. Although the discussion below refers to the exemplary method 200 of operating dryer appliance 100, one skilled in the art will appreciate that the exemplary method 200 is applicable to the operation of a variety of other dryer appliances, such as combination washer/dryer appliances. In exemplary embodiments, the various method steps as disclosed herein may be performed by controller 166 or a separate, dedicated controller.

Figure 3:
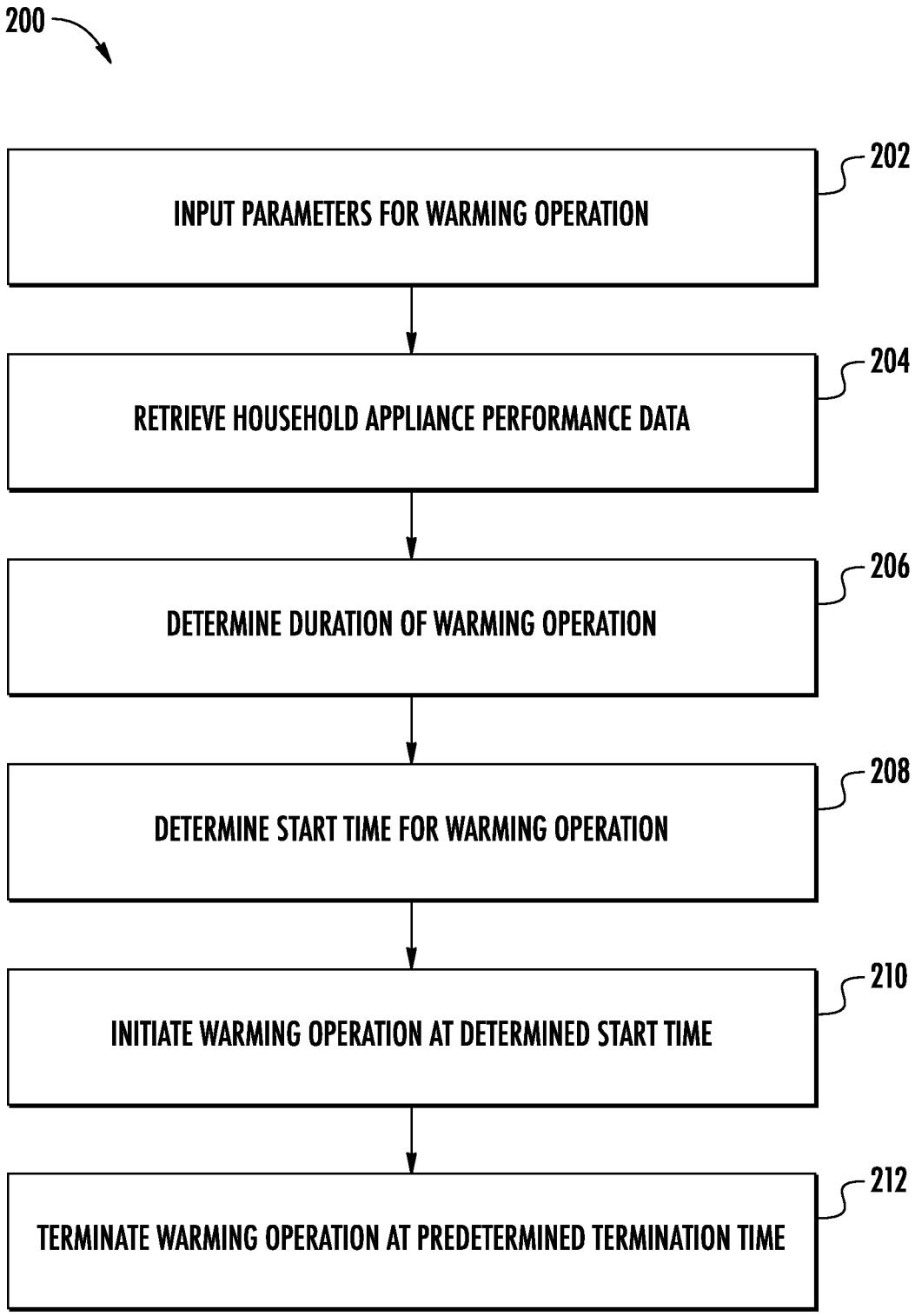
FIG. 3 provides a flowchart illustrating a method of operating a dryer appliance according to an embodiment of the present disclosure.

Referring now to FIG. 3, method 200 is provided for performing a warming operation. In particular, a user may place an article to be warmed in the drum of the dryer appliance 100 and secure the article in the drum by securing the door 134 is the closed position. At 202, instructions may be input to the appliance via the control panel 160 or through the consumer device 66 and received at the processing device 165, or with both the control panel 160 and the consumer device 66. The user enters input parameters of the warming operation using either input method. The input parameters may include desired time for the warmed article (s) to be ready (i.e., termination time of the operation) and a desired temperature or range or temperatures (termination temperature). When termination time and termination temperature are the input parameters, the elapsed time of the warming operation (i.e., the temporal length of the warming operation from the start time to the termination time) may be determined by the processing device 165. For example, an elapsed time may be determined that provides a desirable efficiency for the warming operation. In some embodiments, the user can select the elapsed time for the warming operation in addition to the termination time and termination temperature. A graphic could be included to indicate a sliding scale indicating that as the speed of the warming operation goes up (i.e., warming operation elapsed time decreases), the efficiency of the operation decreases. Other input parameters could include the material of the article or the load size or weight of the article(s). In an embodiment, the weight of the articles may be approximated with weight sensors on the appliance or through the use of a vision system (e.g., using a camera fixed to the appliance or a remote camera, e.g., on a user's mobile phone) for estimating the weight.

A final user input parameter may include an indication of the user's intent to initiate the warming operation. As a safety feature, an input to the controller 166, either directly through a selector button or knob 162 on the control panel 160, or an intentional action on the consumer device 66 (e.g., entering a code) may be required to allow the controller 166 to initiate the warming process. Additional safety features may be included, such as monitoring the position of the dryer appliance door 134 to insure it remains closed throughout the warming process. If the door 134 is sensed to be open before the warming operation begins or during the warming process, the controller 166 may pause the warming operation until appropriate steps are taken. For example, the warming operation may remain paused until the door is sensed to be secured in the closed position or the required steps to re-start, for example an indication of the user's intent to initiate as discussed above, are taken after the door 134 is closed.

At 204, dryer appliance performance data may be retrieved from memory 167. Memory 167 is in communication with all systems and elements in the appliance. Various sensors detect conditions throughout the appliance and communicate the data to the controller 166 and memory 167. The memory 167 can store, for example, historical data of previous cycles, airflow conditions in the dryer appliance 100, load size, inlet and vent temperature sensor readings, operating parameters, cycle settings, performance characteristics, user preferences, efficiencies, or any other suitable information from prior cycles or warming operations as may be useful in analysis of the current operation or performance of the dryer appliance 100.

Stored performance data in memory 167 may include a history of inlet temperatures, as determined by historical inlet temperature sensor 168 data, which can be used to determine inlet temperature slopes (analogous to airflow conditions of the dryer). Generally, lower airflow rates would dictate limiting the heated air 152 temperature being urged into the chamber. In turn, this may lengthen the elapsed time required to yield a successful warming operation. Memory 167 may also store past performance data from past warmup operations.

At 206, controller 166 determines the duration of the warming operation from input parameters and the retrieved performance data. The processing device 165 and memory 167 cooperate to determine the length of time, or duration, of the warming operation based on the input parameters, stored performance data, and calculated performance data. For example, processing device 165 is operable to execute programming instructions associated with one or more mathematical models used in determining the duration of the operation. The memory 167 stores the instructions and the processing device 165 executes the instructions using the data provided. The duration of the warming operation is dependent on the elapsed time entered as an input parameter, as may be modified by the historical performance data, taking into account, e.g., inlet temperature slopes (as an analog to air flow conditions) and past performance. As generally understood, a warming operation using a relatively high heat for a short duration may have the same termination temperature as a warming operation using a lower heat for a long period of time but may be less efficient. The duration may also be dependent on other input parameters, such as material and weight of the article(s).

At 208, the processing device 165 determines the start time for the warming operation. From the input parameters, a predetermined termination time for the warming operation was set by the user. With the determination of the duration of the warming operation in 206, the start time can be determined at the processing device 165 by subtracting the duration (i.e., time period in time units, e.g., hours and minutes) of the warming operation from the predetermined termination time.

At 210, the warming operation is initiated at the determined start time by the controller 166. In response to instructions from the processing device 165, controller 166 operates the various components of dryer appliance 100, for example the motor 142, air handler 148, and heating assembly 146, to execute the selected machine cycles and features as part of a warming operation. The warming process is a closed loop control process that uses information gathered by the inlet temperature sensor 168 and vent temperature sensor 170 and provided to the processing device 165 to adjust the application of heat during the warming operation. In particular, the vent temperature sensor may provide the most accurate temperature information for article(s) exposed to the warming operation.

When the warming operation proceeds for the predetermined time and the termination time is reached, at 212, the warming operation is terminated. At that point, the mathematical models represented by the instructions stored in memory 167 and executed by processing device 165, the article in the drum has reached the user-desired temperature. At the termination time, the dryer appliance may provide a signal to the user that the end of cycle has been reached. The signal could be an auditory signal, a visual signal, or both, at the appliance. In other embodiments the signal may be sent to the consumer device 66 as a visual signal, an auditory signal, a vibration, or any other indicator that the warming operation has terminated and the article is ready.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dryer appliance comprising:

a cabinet;

a drum rotatably mounted within the cabinet, the drum defining a chamber for receipt of an article for warming;

an air handler for urging a flow of air through the chamber;

a heating assembly for heating the flow of air;

a control panel coupled to a portion of the cabinet; and a controller in operable communication with the heating assembly, the air handler, and the control panel, the controller being configured to initiate a warming operation independent of a drying process on the article in the drum, the warming operation comprising:

receiving input parameters of the warming operation from the control panel, wherein the input parameters comprise a user defined predetermined termination time of the warming operation and a user defined temperature for an article in the drum at the predetermined termination time of the warming operation;

determining a duration of the warming operation from the input parameters;

determining a start time for the warming operation from the input parameters and the determined duration, wherein determining the start time comprises subtracting the determined duration of the warming operation from the predetermined termination time; and initiating the warming operation for the article at the determined start time.

2. The dryer appliance of claim 1, wherein the warming operation further comprises:

terminating the warming operation at the predetermined termination time.

3. The dryer appliance of claim 1, wherein the input parameters include an elapsed time for the warming operation.

4. The dryer appliance of claim 1, wherein the warming operation further comprises:

retrieving dryer appliance performance data; and using the dryer appliance performance data in determining the duration of the warming operation.

5. The dryer appliance of claim 4, wherein the dryer appliance performance data is retrieved from a memory in the controller.

6. The dryer appliance of claim 4, wherein the dryer appliance performance data includes at least one of an airflow condition in the dryer appliance, an efficiency of the dryer appliance, an input from an inlet temperature sensor, and an input from a vent temperature sensor.

7. The dryer appliance of claim 1, wherein the input parameters are received by the controller from one or more of a consumer device and the control panel coupled to the portion of the cabinet.

8. The dryer appliance of claim 7, wherein the consumer device is linked to the controller through one of a direct link and a network link.

9. A method of operating a dryer appliance, the dryer appliance comprising a drum rotatably mounted within a cabinet and an article in the drum and a control panel coupled to a portion of the cabinet, the method comprising:

receiving input parameters for a warming operation from the control panel, wherein the warming operation is independent of a drying process, wherein the input parameters comprise a user defined predetermined termination time of the warming operation and a user defined temperature for an article in the drum at the predetermined termination time of the warming operation;

determining a duration of the warming operation from the input parameters;

determining a start time for the warming operation from the input parameters and the determined duration, wherein determining the start time comprises subtracting the determined duration of the warming operation from the predetermined termination time; and initiating the warming operation for the article at the determined start time.

10. The method of claim 9, wherein the warming operation further comprises:

terminating the warming operation at the predetermined termination time.

11. The method of claim 9, wherein the input parameters include an elapsed time for the warming operation.

12. The method of claim 9, wherein the warming operation further comprises:

retrieving dryer appliance performance data; and using the dryer appliance performance data in determining the duration of the warming operation.

13. The method of claim 12, wherein the dryer appliance performance data is retrieved from a memory in the controller.

14. The method of claim 12, wherein the dryer appliance performance data includes at least one of an airflow condition in the dryer appliance, an efficiency of the dryer appliance, an input from an inlet temperature sensor, and an input from a vent temperature sensor.

15. The method of claim 9, wherein the input parameters are received by the controller from one or more of a consumer device and the control panel coupled to the portion of the cabinet.

16. The method of claim 15, wherein the consumer device is linked to the controller through one of a direct link and a network link.

* * * * *